United States Patent [19]

Itou

[11] Patent Number: 4,542,851

[45] Date of Patent: Sep. 24, 1985

[54] AIR CONDITIONER FOR A COATING BOOTH

[75] Inventor: Zyouzi Itou, Aichi, Japan

[73] Assignee: Toyota Jidosha Kabushiki Kaisha, Toyota, Japan

[21] Appl. No.: 509,382

[22] Filed: Jun. 30, 1983

[30] Foreign Application Priority Data

Dec. 18, 1982 [JP] Japan ..... 57-222583

[51] Int. Cl.[4] ..... G05D 21/00

[52] U.S. Cl. ..... 236/44 C; 165/20

[58] Field of Search ..... 236/44 R, 44 L; 62/91; 165/20

[56] References Cited

U.S. PATENT DOCUMENTS 2,107,268 2/1938 Avery et al. ..... 165/21 X
2,222,628 11/1940 Newton ..... 165/20
3,263,737 8/1966 Brummendorf ..... 165/20 X
3,346,040 10/1967 Cohen ..... 236/44 R X
3,478,817 11/1969 Shaw ..... 236/44 L X

FOREIGN PATENT DOCUMENTS 777881 7/1957 United Kingdom ..... 236/44 R

*Primary Examiner*—William E. Wayner
*Attorney, Agent, or Firm*—Oblon, Fisher, Spivak, McClelland & Maier

[57] ABSTRACT

An air conditioner for a coating booth wherein for the purpose of feeding the air into the coating booth at a predetermined temperature and humidity there are provided devices for heating the recirculating water in the storage tank to the dew point temperature and devices for electrical controlling to automatically keep the temperature and humidity of the air to predetermined values.

9 Claims, 2 Drawing Figures

AIR CONDITIONER FOR A COATING BOOTH

BACKGROUND OF THE INVENTION

1. Field of the Invention

This invention relates to an air conditioner which supplies air at a controlled specified temperature and humidity to a coating booth.

Generally the finishing quality of a coating or paint in a coating booth highly depends upon the temperature and humidity of the air led in the coating booth. Therefore, especially in case of, for example, a body of an automobile or the like, which is required to have a high quality coating, not only must the air supplied to the coating booth have dust eliminated therefrom, but also the temperature and the humidity of the air are strictly controlled to specific limits.

Accordingly, this invention relates to an improvement in the air conditioner for the coating booth to be used in coating an automobile body or the like which is required to have a high quality coating.

2. Description of the Prior Art

In the conventional air conditioner for controlling the air supplied to the coating booth at a predetermined temperature and humidity, dust in the air is first eliminated by a filter. The clean air is then passed between plate fin coils in which heated steam flows, to transmit heat to the air. Subsequently the air thus heated goes by articles, called "wet wall units" on the surface of which heated water flows down from the top to the bottom of the articles. The air is humidified due to the contact of the air with the heated downward flowing water. Subsequently the air is again heated by passing through another plate fin coil heater within which flows steam.

In order to humidify the air to a predetermined humidity in this humidifying step of the conventional air conditioner, it is necessary to heat the water which flows down the so-called wet walls to some predetermined temperature. Normally, the heated water thus flowing down the surface of the wet walls is supplied as recirculating water for energy-saving reasons. Thus, a predetermined amount of the energy for heating the recirculating water is used to humidify the air passing by. In this case, the smaller the ratio of the recirculating water to the amount of air which passes by the wet walls, the higher the temperature of the recirculating water should be. However, since the recirculating water is normally preheated in a tank where the water is stored after flowing down on the wet walls, there occurs a temperature difference for the heated water between the upper portion of the wet walls from which the recirculating water starts flowing and the lowermost portion of the wet walls. This temperature difference can become large, so that to ensure the humidification of the air even at the lowermost portion of the wet walls, the initial temperature of the recirculating water must be so high that the air which passes through the upper portion of the wet walls is excessively humidified and becomes supersaturated. Thus, foglike water droplets are produced in the air, and the temperature and humidity of the air cannot be sufficiently controlled. Further, water droplets can precipitate in a duct leading to the coating booth. Therefore, a large amount of recirculating water must normally be provided for reducing and equalizing the temperature difference between the upper portion and the lowermost portion of the wet walls. Accordingly, a large amount of energy is wasted.

SUMMARY OF THE INVENTION

In order to overcome the above-described drawback, the present invention proposes a method of controlling the air with a predetermined humidity by a step of, instead of only heating the circulating water in the water storage tank, atomizing steam directly to the supplied air at a point upstream of the air passing by the wet wall units, thereby supplying energy for humidifying the air to the recirculating water flowing down the wet walls. According to this method, since the atomized steam uniformly contacts the entire surface of the wet wall units, the temperature difference between the upper portion and the lowermost portion of the walls becomes small, and the air can be uniformly humidified. However, when the circulating water temperature is lowered due to the non-use of the apparatus of this method for a long period of time, the predetermined humidity cannot be obtained quickly in case of restarting the air conditioner until the steam atomized into the air is absorbed by the circulating water and it reaches the predetermined temperature. Thus, it takes a long time for start up and a large amount of energy is thus wasted.

Accordingly a further feature of the present invention is an air conditioner for a coating booth which can heat and humidity the air supplied to the coating booth to a predetermined dew point temperature in a short time by employing an additional heating device different from the steam atomization device upstream of the humidifier.

Another feature of the present invention is a heating device and humidifying device which are controlled by controllers. The amount of heating energy of the steam to be atomized into the air and the amount of the heat energy radiated from the recirculating water into the air are thus equalized, whereby the time for heating the recirculating water is reduced and the temperature of the air is raised to the predetermined dew point temperature and humidity in a short time.

More particularly, the air conditioner for a coating booth of the present invention advantageously includes a humidifying device in which recirculating water is flowing down an article such as a wet wall. A steam atomizing device atomizes steam directly into the air before its coming in contact with the flowing water. Means are provided for raising the temperature of the recirculating water to a set dew point temperature in the coating booth for an automobile body or the like, by a heating device provided in a water storage tank of the recirculating water of the humidifying device.

In this air conditioner, the heating device provided in the water storage tank may be a type which sprays steam directly into the tank or may be an electric heater. The heating device operates upon a signal from a thermostat for a dew point temperature provided in the booth and continues to operate until the circulating water in the tank is heated to the predetermined dew point temperature, after restarting the air conditioner which is stopped for a long period of time. The operation of a steam atomizing device may be performed similarly.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
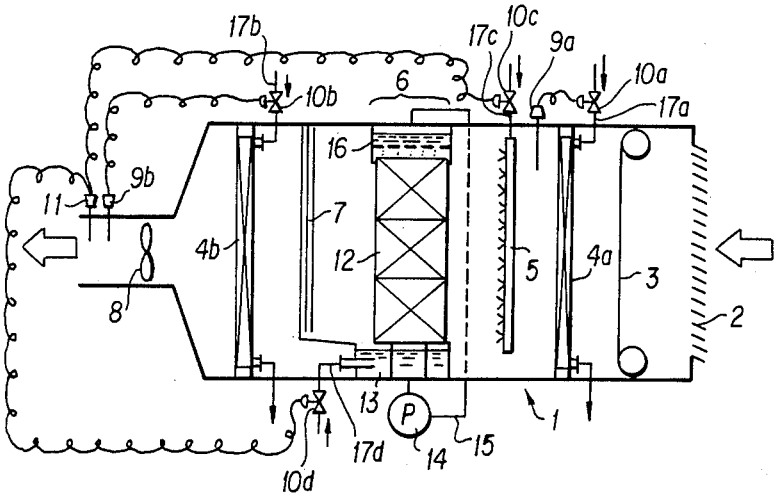
FIG. 1 is a schematic sectional view of an embodiment of the air conditioner for a coating booth according to the present invention.

In FIG. 1 the air conditioner 1 consists of a grille 2 forming an air intake port, a filter 3 through which dust is removed from the intaken air, a plate fin coil heater 4*a* which heats the air passing by to a predetermined temperature, a steam atomizing tube 5 for atomizing steam directly into the air, wet wall units 6 for humidifying the air, an eliminator 7 for collecting, water droplets scattered into the air by the units 6, a plate fin coil heater 4*b* for again heating the humidified air to a predetermined temperature, and a fan 8 for supplying the air conditioned to the predetermined temperature and humidity into a coating booth. The above structure is also disclosed in Applicants copending application having the same title as the present application, and which is incorporated by reference.

Represented by numeral 9*a* is a temperature controller which is positioned between fin coil heater 4*a* and atomizing tube 5 in the air path and which sends an electrical signal so long as the temperature of the air is under a predetermined value. The signal is sent to a valve control device (not shown) to adjust the extent of opening of the valve 10*a* provided for the steam supplying pipe 17*a*. The receipt of the signal causes the valve 10*a* to increase the steam volume until the temperature of the air rises to the predetermined value.

A conventional control device may be applied for controlling the extent of the opening of the valve 10*a*.

Represented by numeral 9*b* is another temperature controller which is positioned in the coating booth or the duct to the coating booth (subsequently referred to simply as the coating booth) and sends an electric signal so long as the temperature of the air in the coating booth is under a predetermined value. The signal is sent to a valve control device (not shown) to adjust the extent of the opening of the valve 10*b* provided for the steam supplying pipe 17*b* so as to increase or decrease steam volume in a manner similar to that mentioned above.

Represented by numeral 11 is a dew point controller which is positioned in the coating booth and sends an electric signal so long as the dew point temperature is not at a predetermined value. The signal is sent to a valve control device (not shown) to adjust the extent of the opening of the valve 10*d* provided for the steam supplying pipe 17*d* so as to increase or decrease the volume of the steam to be sprayed into the lower tank 13.

Represented by numeral 14 is a pump which pumps up the recirculating water accumulated in the tank 13 to the sprinkling tank 16 via a pipe 15.

In the air conditioner thus constructed as described above, the filter 3 employs a non-woven cloth having approximately 20 mm of thickness, which is extended from an upper roll to a lower roll in such a manner as to be wound from one to the other as required. The plate fin coil heaters 4*a*, 4*b* are composed of pipes attached to a number of fins, through which the steam is passed, and are formed in a panel shape. The wet wall material 12 is formed of a net-shaped or lattice-shaped molded plastic, or a cage-shaped or spherical filler having a number of fins. The eliminator 7 is constructed so as to permit the air pass between a number of bent plates.

The operation of the air conditioner thus constructed will now be described.

The air is drawn from the grille 2 into the air conditioner 1 by the operation of the fan 8. The dust in the intaken air is removed by the filter 3. The clean air is then heated by the plate fin coil heater 4*a*, which is heated by steam, to a predetermined temperature. This heating is performed only to the extent that the air is not excessively saturated in the next step of being humidified wherein the steam is atomized from the tube 5 directly into the air. The atomized steam is partly absorbed in the recirculating water flowing down the wet wall units 12 and the temperature of the water is increased so as to humidify the air passing by the wet wall units 12. The air, of course, is also humidified directly by the steam atomization.

The air thus humidified by the wet wall units 6 is accompanied by water droplets of the recirculating water which are scattered into the air by the wet wall units 6, and when passing through the eliminator 7, the water droplets are separated from the air. Then, the air is again heated by the coil 4*b* to the predetermined temperature, and is fed to the coating booth.

If the temperature of the air passed through the plate fin coil heater 4*a* does not reach the predetermined temperature, the controller 9*a* causes the valve 10*a* open wider to increase the amount of steam passing through the steam pipe 17*a*, thereby heating the air to the predetermined temperature. The controlling of the valve 10*c* is done by the controller 11 in accordance with the set dew point temperature to control the amount of the steam through the pipe 17*c* to the steam atomizing tube 5, and the tube 5 atomizes the necessary amount of steam. The extent of opening of the valve 10*d* is also controlled by the controller 11 in accordance with its signal; a predetermined amount of steam is thus supplied through the pipe 17*d* directly to the recirculating water in the storage tank 13 of the wet wall units 6, and the recirculating water is accordingly always controlled to the dew point temperature. Since the dew point temperature rises with increased humidity, the sensing of an actual dew point temperature below the predetermined dew point tempertaure causes the valve control device (not shown) to open one or both of the valves 10*c* and 10*d*. The extent of the opening of the valve 10*b* is controlled in accordance with the set temperature of the temperature controller 9*b*. The necessary amount of steam is thus supplied through the pipe 17*b*, thereby again heating the air to the predetermined temperature.

Figure 2:
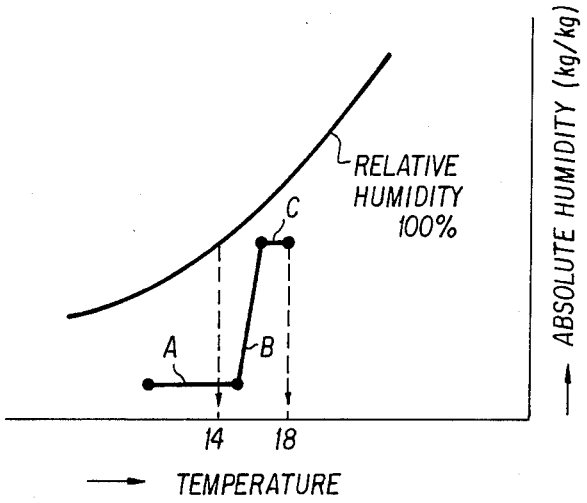
FIG. 2 is an air humidity graph.

The operation described above is performed in winter when the atmospheric temperature is low. In FIG. 2, there is shown an air humidity graph illustrating the relative variations in the temperature and humidity in accordance with every step of the air conditioner of the present invention. In the embodiment mentioned above, the temperature is eventually controlled to 18° C., and the dew point temperature is controlled to 14° C. In FIG. 2, arrow A designates the heating accomplished by the plate fin coil heater 4*a*, arrow B designates the humidity provided by the steam atomizing tube 5 and the wall units 6, and arrow C designates the heating accomplished by the plate fin coil heater 4*b*.

Since the recirculating water in the lower tank is heated directly by the heating device 10*d*, 17*d* to the dew point temperature, when the air conditioner is restarted, even after a long period of no operation resulting in the temperature of the recirculating water being lower than the set dew point temperature, the temperature of the steam atomized into the air will not be substantially lowered due to transmitting of its heat to the recirculating water. Thus substantially all the steam atomized into the air from the steam atomizing tube can be used for humidifying the air. Consequently, the time for raising the temperature of the air to the dew point temperature is greatly shortened, and wasteful energy consumption in the starting up operation of the apparatus can be reduced. For example, in the conventional air conditioner it takes 30 minutes for the start up operation, however according to the present invention it takes only 5 minutes.

As apparent from the above description, since the air conditioner of the present invention employs not only the wet wall units but also the steam atomizing tube, the amount of recirculating water can be reduced as compared with the conventional air conditioner which employs only the wet wall units. Consequently, the heating of the recirculating water can be accelerated. Further, since a fine adjustment of the temperature can be performed with the steam atomizing tube 17*d*, the required temperature and humidity of the air can be obtained readily in case of restarting the air conditioner.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An air conditioner for a coating booth comprising:
means for drawing air through a filter;
first means for heating the filtered air;
means for atomizing steam into said heated air;
means downstream from said means for atomizing for humidifying said heated air, said means for humidifying including wet walls and recirculating water flowing on said wet walls;
a storage tank for said recirculating water;
second means for heating said recirculating water in said storage tank; and
dew point temperature control means sensitive to a dew point temperature in said coating booth and operatively connected to said second means for heating for maintaining a predetermined dew point temperature in said coating booth.

2. The air conditioner of claim 1, wherein said heating means comprise a plate fin coil heater supplied with steam from a first pipe, a first valve provided in said first steam pipe, a first controller provided between the first heating means and the atomizing means, and means associated with said first controller for adjusting said first valve.

3. The air conditioner of claim 1, wherein said atomizing means comprises an atomizing tube supplied with steam from a second steam pipe, a second valve provided in said second steam pipe, a second controller provided in the coating booth, and means associated with said second controller for adjusting said second valve.

4. The air conditioner of claim 1, wherein said second heating means comprise an atomizer supplied with steam from a third pipe and a third valve provided in said third steam pipe, said third valve being controlled by said dew point temperature control means.

5. The air conditioner of claim 1, wherein the second heating means is an electric heater.

6. The air conditioner of claim 2, wherein said atomizing means comprises an atomizing tube supplied with steam from a second steam pipe, a second valve provided in said second steam pipe, a second controller provided in the coating booth, and means associated with said second controller for adjusting and second valve.

7. The air conditioner of claim 2, wherein said second heating means comprise an atomizer supplied with steam from a third pipe and a third valve provided in said third steam pipe, said third valve being controlled by said dew point temperature control means.

8. The air conditioner of claim 3, wherein said second heating means comprise an atomizer supplied with steam from a third pipe and a third valve provided in said third steam pipe, said third valve being controlled by said dew point temperature control means.

9. A method for conditioning the air for a coating booth comprising steps of:
cleaning the air by a filter;
heating the filtered air by a plate fin coil;
atomizing steam into said heated air;
humidifying the heated and atomized air by a wet wall including recirculating water;
reheating the humidified air;
controlling the heating of the filtered air to a predetermined temperature;
controlling the temperature of the atomized air to a predetermined temperature; and
controlling the temperature of the recirculating water according to a dew point temperature in the coating booth.

* * * * *